US008550276B2

(12) United States Patent
Richard et al.

(10) Patent No.: US 8,550,276 B2
(45) Date of Patent: Oct. 8, 2013

(54) CYLINDRICAL STRUCTURE MADE UP OF RECTANGULAR ELEMENTS

(75) Inventors: Yves Richard, Chaville (FR); Adnan Ezzarhouni, Guyancourt (FR)

(73) Assignee: Gaztransport et Technigaz, Saint Remy les Chevreuse (FR)

( * ) Notice: Subject to any disclaimer, the term of this patent is extended or adjusted under 35 U.S.C. 154(b) by 608 days.

(21) Appl. No.: 12/447,534

(22) PCT Filed: Jan. 23, 2008

(86) PCT No.: PCT/FR2008/050103
§ 371 (c)(1),
(2), (4) Date: Apr. 28, 2009

(87) PCT Pub. No.: WO2008/107606
PCT Pub. Date: Sep. 12, 2008

(65) Prior Publication Data

US 2010/0071285 A1 Mar. 25, 2010

(30) Foreign Application Priority Data

Feb. 13, 2007 (FR) ..... 07 53220

(51) Int. Cl.
*B65D 6/00* (2006.01)

(52) U.S. Cl.
USPC ..... 220/4.12; 220/612; 220/679; 52/192

(58) Field of Classification Search
USPC ..... 52/192, 270, 284; 220/4.28, 565, 220/4.12, 4.16, 612, 678–680
See application file for complete search history.

(56) References Cited

U.S. PATENT DOCUMENTS

| | | | | | |
|---|---|---|---|---|---|
| 1,599,110 | A * | 9/1926 | Baldwin | 220/614 |
| 2,126,996 | A * | 8/1938 | Kramer | 220/693 |
| 2,237,308 | A * | 4/1941 | Larson | 220/653 |
| 2,499,054 | A * | 2/1950 | Collins et al. | 210/513 |
| 2,748,904 | A * | 6/1956 | Arndt | 52/247 |
| 3,225,955 | A * | 12/1965 | Farkas et al. | 220/560.1 |
| 3,277,620 | A * | 10/1966 | Martin | 52/82 |
| 3,511,003 | A | 5/1970 | Alleaume | |
| 3,979,871 | A * | 9/1976 | Pollock | 52/270 |
| 4,225,054 | A | 9/1980 | Jean | |
| 4,756,163 | A | 7/1988 | Garg | |
| 4,760,932 | A * | 8/1988 | Rhodes, Jr. | 220/4.16 |
| 6,638,348 | B2 | 10/2003 | Kuriiwa et al. | |
| 2004/0118844 | A1 * | 6/2004 | Bennett et al. | 220/4.12 |

FOREIGN PATENT DOCUMENTS

| | | |
|---|---|---|
| FR | 1 457617 | 1/1966 |
| FR | 1.546.524 | 11/1968 |
| FR | 2 398 961 | 2/1979 |
| FR | 2 739 675 | 4/1997 |
| FR | 2 877 693 | 5/2006 |
| WO | 00/21847 | 4/2000 |

OTHER PUBLICATIONS

International Search Report dated Sep. 12, 2008, from correspond PCT application.
Taiwan Search Report, dated Oct. 29, 2012, in corresponding 097129445.

* cited by examiner

*Primary Examiner* — Brian Glessner
*Assistant Examiner* — Jessie Fonseca
(74) *Attorney, Agent, or Firm* — Young & Thompson

(57) ABSTRACT

A cylindrical structure includes a vertical wall (3) and a bottom wall (2), the bottom wall having a plurality of sectors (4) which are rotated images of each other, each sector including a plurality of adjacent rectangular elements (8), characterized by the fact that the bottom wall has the shape of a regular polygon whereof each side (6) corresponds to one of the sectors, the edges of the rectangular elements of one sector being respectively perpendicular and parallel to the side of the polygon corresponding to the sector.

19 Claims, 4 Drawing Sheets

CYLINDRICAL STRUCTURE MADE UP OF RECTANGULAR ELEMENTS

Figure 1:
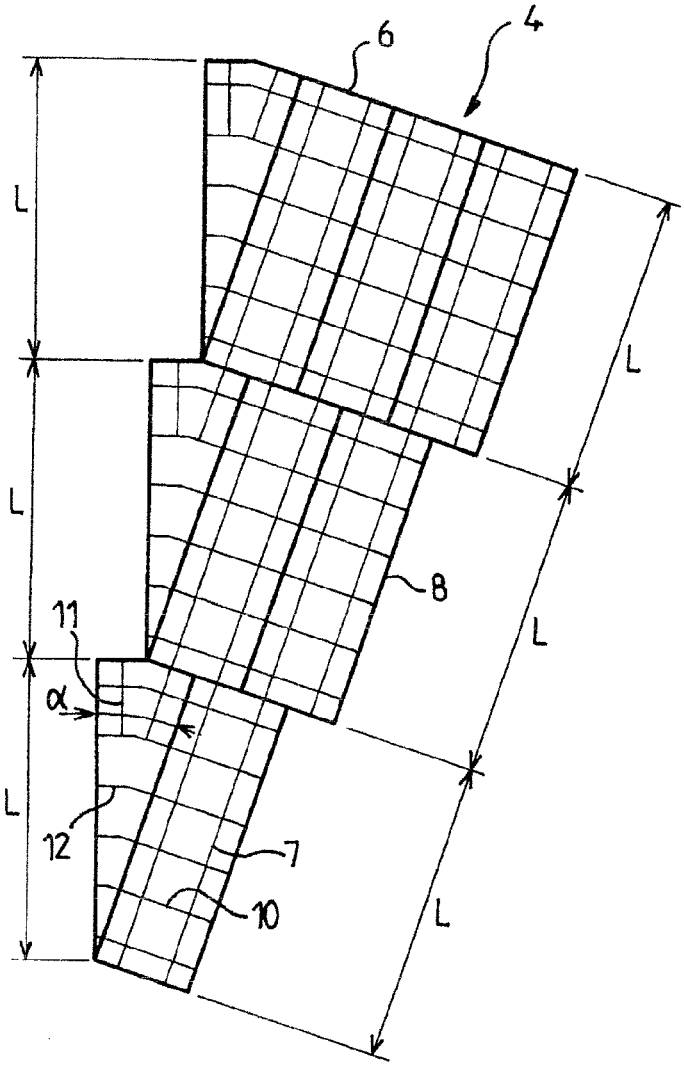

The present invention relates to a cylindrical structure whereof the vertical wall and the bottom wall comprise a plurality of adjacent rectangular elements, and in particular a tight and thermally insulated tank.

Document FR 1 457 617 describes a ground tank for the storage of liquefied natural gas. This tank comprises a sealing membrane made up of rippled metallic panels. In one embodiment, the circular bottom wall is covered by a plurality of rectangular panels distributed by symmetrical sections, and by connecting panels between sectors. This arrangement makes it possible to cover a large part of the surface of the bottom wall with rectangular panels. However, as the bottom wall is circular, it is necessary to provide for special non-rectangular panels between the straight edges of the rectangular panels and the circumference of the bottom wall. The number of different panels needed to cover the entire bottom wall is therefore high.

Document FR 2 739 675 describes a tank whereof the bottom wall is covered by a plurality of rippled panels. The rippled panels have radial edges. Cutting these panels is therefore more complicated than in the case of rectangular panels, and can lead to a significant discard quantity, which is particularly undesirable when the panels are made in an expensive material. Furthermore, different types of panels with radial edges are necessary to cover all of the bottom wall.

Document FR 2 398 961 describes a tank whereof the bottom wall is covered by a plurality of rectangular strakes all parallel to each other. This involves connection difficulties at the intersection of the bottom wall with the vertical wall of the tank. Moreover, cutting the strakes leads to a significant discard quantity.

The problem the present invention seeks to resolve is to propose a cylindrical structure or a tank which does not present at least some of the aforementioned drawbacks of the prior art, and in particular which can be realized with a reduced number of shapes for the pieces.

The solution proposed by the invention is a cylindrical structure comprising a vertical wall and a bottom wall, said bottom wall having a plurality of sectors which are images of each other by rotation, each sector comprising a plurality of adjacent rectangular elements, characterized by the fact that said bottom wall has the shape of a regular polygon whereof each side corresponds to one of said sectors, the edges of the rectangular elements of one sector being perpendicular and parallel, respectively, to the side of the polygon corresponding to said sector.

Thanks to these characteristics, a large part of the bottom wall can be made up of rectangular elements. Moreover, the rectangular elements of the bottom wall can extend to the rectilinear sides of the bottom wall, and in this case no special element is necessary between the rectangular elements and the sides. The rectangular elements of the bottom wall can also extend up to a small distance from the rectilinear sides of the bottom wall, and have edges parallel to the sides. In this case, the bottom wall can easily be completed by rectilinear elements which extend along the sides of the bottom wall, for example corner beads. In both cases, only a limited number of different elements is needed to form all of the bottom wall.

Preferably, said bottom wall comprises a plurality of identical polygonal connecting elements connecting two adjacent sectors.

In this way, one limits the number of different elements necessary. The connecting elements can, for example, be quadrilaterals or octagons.

Advantageously, said vertical wall comprises a plurality of adjacent rectangular elements, said rectangular elements of the vertical wall being identical to the rectangular elements of the bottom wall.

In this case, the number of different elements necessary to form the bottom wall and the vertical wall is limited.

The invention also proposes a tight and thermally insulated tank, comprising a sealing barrier and a thermally insulating barrier, characterized by the fact that it comprises a cylindrical structure according to the invention above.

In this case, the rectangular elements can be elements of the sealing barrier and/or the thermally insulating barrier. For example, said rectangular elements comprise rippled panels forming the sealing barrier or metallic strakes with raised edges forming the sealing barrier. One can also provide that said rectangular elements comprise panels in a thermally insulating material forming the thermally insulating barrier.

Preferably, said bottom wall comprises a central piece to which the most central rectangular elements of each sector are connected.

According to one particular embodiment, the tank comprises a rectilinear corner bead arranged along one side of said bottom wall, said corner bead comprising a horizontal board to which the most off center rectangular elements of a sector are connected, and a vertical board to which the rectangular elements of the vertical wall are connected.

A bead of this type makes it possible to easily connect the bottom wall elements to those of the vertical wall.

Figure 2:
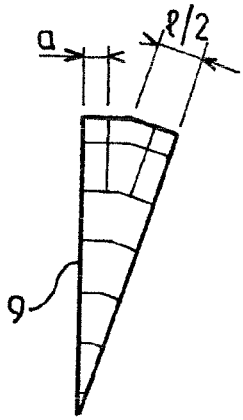
Figure 3:
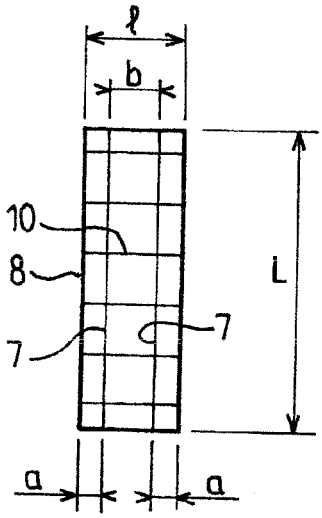
Figure 4:
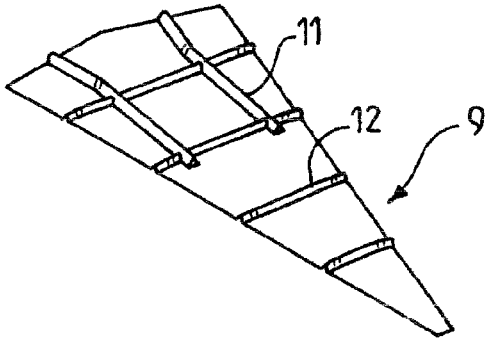
Figure 5:
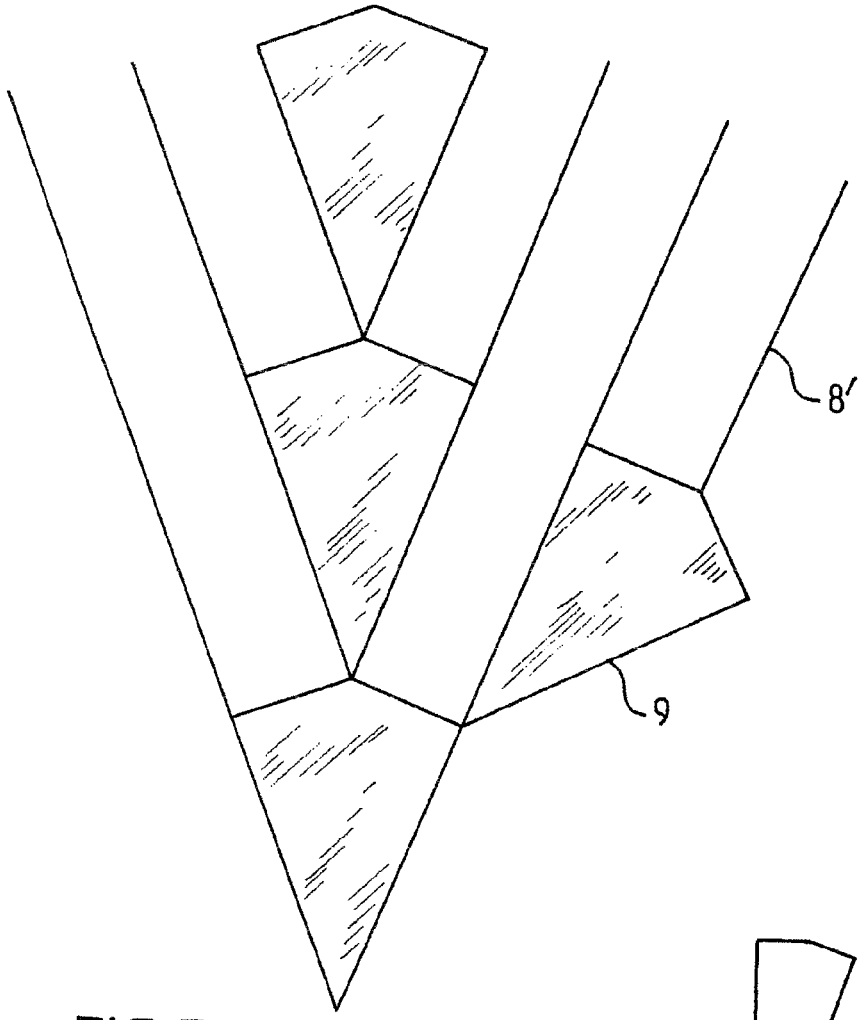
Figure 8:
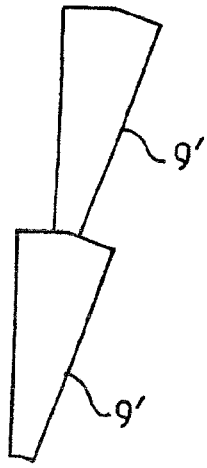
Figure 6:
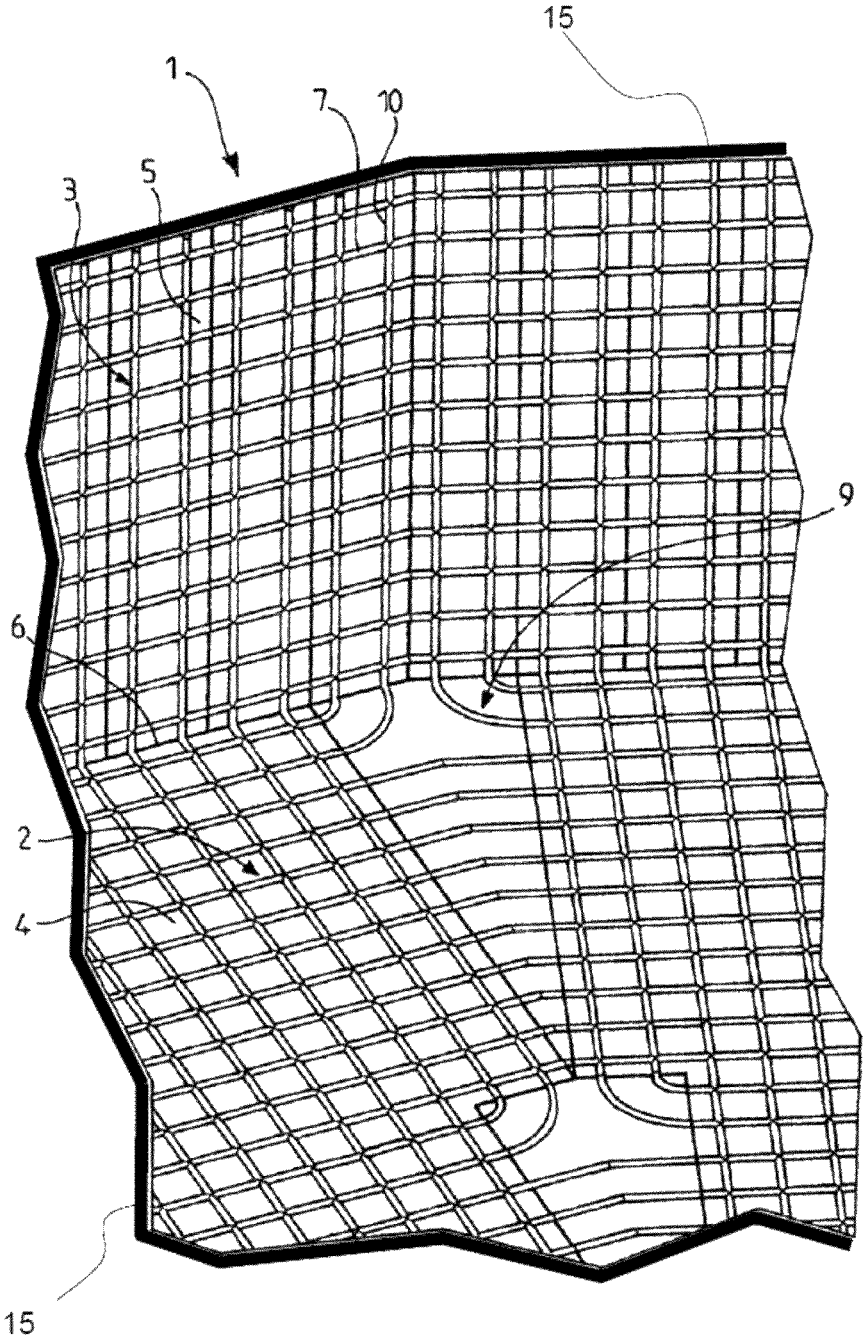
Figure 7:
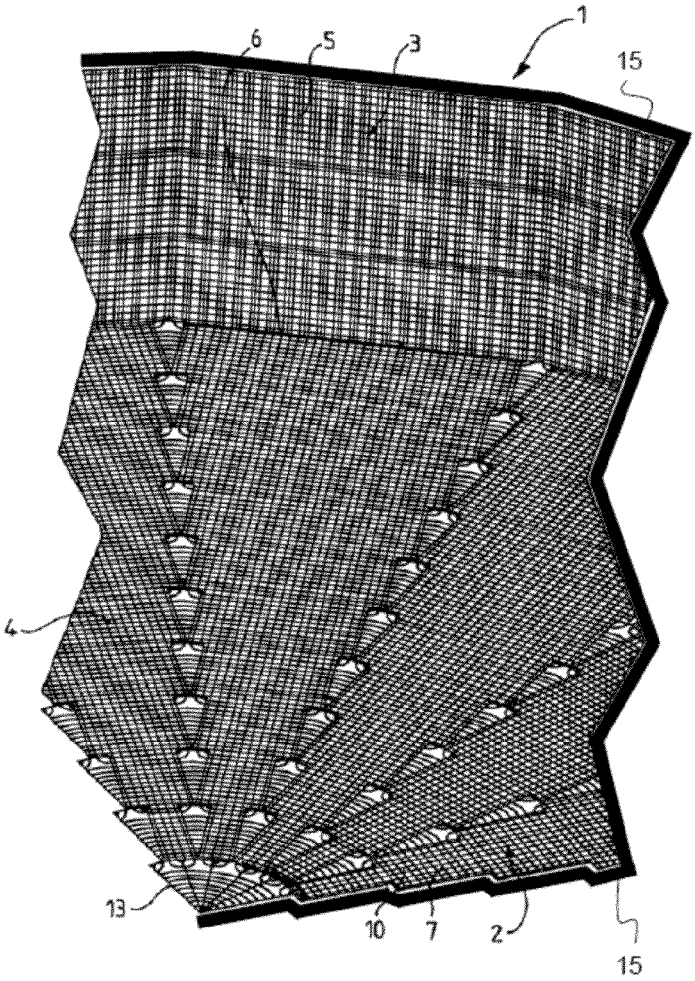
Figure 9:
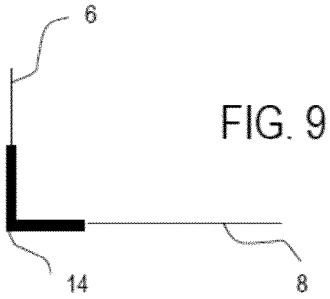

The invention will be better understood, and other aims, details, characteristics and advantages thereof will appear more clearly during the following description of several particular embodiments of the invention, provided solely as non-limiting examples, in reference to the appended drawings. In these drawings:

FIG. 1 is a top view of a sector and connecting elements of a tank according to one embodiment of the invention, FIG. 2 is a top view of a connecting element of the tank of FIG. 1, FIG. 3 is a top view of a rectangular element of the tank of FIG. 1, FIG. 4 is a perspective view of the connecting element of FIG. 2, FIG. 5 is a partial top view of the bottom wall of a tank according to another embodiment of the invention, FIGS. 6 and 7 are partial perspective views of the tank of FIG. 1, with connecting elements according to a first variation of embodiment, FIG. 8 illustrates two connecting elements according to a second variation of the invention, FIG. 9 is a schematic of a rectilinear corner bead connecting a bottom wall to a vertical wall.

In FIGS. 6 and 7, we have illustrated the tight membrane of a ground tank 1 for the storage of liquefied natural gas (LNG). The tank 1 also comprises a concrete support structure, which is not illustrated, and a thermally insulating barrier 15, which is schematically illustrated, located between the tight membrane and the support structure.

The tight membrane of the tank 1 is a cylindrical structure which comprises a bottom wall 2 and a vertical wall 3. The bottom wall 2 has the shape of a regular polygon, with twenty sides 6 in the example shown in FIGS. 6 and 7. However, the invention concerns other types of polygons, in particular with five sides or more.

The bottom wall 2 has a plurality of sectors 4 each corresponding to a side 6. The sectors 4 are rotated images of each other. The vertical wall 2 is made up of a plurality of vertical faces 5 each corresponding to a side 6.

The bottom wall 2 and the vertical wall 3 are made up of a plurality of metallic panels connected to each other by welding, and which have ripples allowing the contraction of the panels during temperature variations. Fixing and welding of the panels as well as the formation of the ripples can be done according to techniques known in the field of LNG storage or transport tanks.

On the bottom wall 2, the metallic panels comprise rectangular panels 8 having a length L and width 1, shown in FIG. 3, as well as connecting panels 9 in a symmetrical quadrilateral shape, having two sides with a length L and two sides with a length 1/2, shown in FIG. 2.

FIG. 1 shows how the rectangular panels 8 are arranged to cover a sector 4 of the bottom wall 2. A plurality of rectangular panels 8 are arranged according to three rows, with the width parallel to the side 6. From one row to the next, the rectangular panels 8 are arranged in staggered rows and each time there is one less panel 8 as one approaches the center. Of course, depending on the dimensions of the bottom wall 2 and the rectangular panels 8, there may be more or less than three rows. For example, in the embodiment shown in FIG. 7, there are ten rows.

Thanks to the arrangement of the rectangular panels 8 described above, the space left free between a panel 8 located at the end of a row of a first sector and the panel 8 located at the end of a corresponding row of a second adjacent center, always has an identical symmetrical quadrilateral shape. All these spaces with identical shapes can therefore be occupied by a plurality of connecting panels 9.

Thus, as in the example shown in FIG. 1, the width of the outermost rectangular panels 8 is mixed with the side 6, the bottom wall 2 can be entirely formed with a plurality of identical rectangular panels 8, a plurality of identical connecting panels 9, and a central piece 13, which can potentially be formed by connecting panels 9 as shown in FIG. 7. The bottom wall 2 is therefore made up of two or, at most, three different types of panels.

In one embodiment illustrated schematically in FIG. 9, the small side of the outermost rectangular panels 8 is not mixed with the side 6, but is a small distance away from it, for example 10 cm. A rectilinear corner bead with an L-shaped section is arranged along the side 6. The corner bead comprises a horizontal board to which the most off center rectangular panels 8 are connected, by their width. The corner bead also comprises a vertical board to which the panels of the vertical wall are connected. The corner bead is only one example of connection between the bottom wall 2 and the vertical wall 3. This connection can be realized according to other techniques, for example similarly to the connection rings used in the field of LNG transport tanks. Regardless of the technique chosen, as it involves making a connection between two perpendicular walls made up primarily of rectangular panels whereof the edges are parallel and perpendicular to the intersection edge, this connection is relatively simple and requires only a limited number of pieces.

The vertical wall 3 is made up of rectangular metallic panels. In one embodiment, these are the same rectangular panels 8 as those of the bottom wall 2, which makes it possible to limit the number of types of panels needed. At the sides 6, the longitudinal ripples 7 of the bottom wall 2 can be connected to the corresponding longitudinal ripples 7 of the vertical wall 3, which makes it possible to limit the constraints due to thermal contraction.

As previously stated, the panels have ripples allowing them to contract when temperature variations take place. More specifically, the rectangular panels 8 have two longitudinal ripples 7 and a plurality of transverse ripples 10. The longitudinal ripples 7 are located at a distance a from the long edges and at a distance b=2a from each other. As can be seen in FIG. 1 in particular, the ripples 7 and 10 of the rectangular panels 8 are connected to each other. The connecting panels 9 also have ripples connected to the ripples of the adjacent rectangular panels 8. In the example of FIG. 4, the connecting panel 9 comprises terminal ripples 11 connected to longitudinal ripples 7, and connecting ripples 12 connected to the transverse ripples 10 of the adjacent rectangular panels 8. Other arrangements of the ripples on the connecting panels 9 are possible, and one example is illustrated in FIG. 6.

FIG. 5 illustrates a different arrangement of the panels of the bottom wall 2. In this embodiment there are, at each connecting panel 9, two fewer rectangular panels 8' as one approaches the center. In this embodiment, instead of using rectangular panels 8 which all have the same length L corresponding to the length of one side of the connecting panels 9, one can use rectangular panels 8' of different lengths, which for example extend from the side 6 of the bottom wall to a small edge of a connecting panel. These rectangular panels 8' can for example be strakes with raised edges, the production of which and fixing on welding media are known in the field of LNG storage or transport tanks. Such strakes can be produced in a material with a small coefficient of expansion, for example in Invar, and are not provided with ripples.

The thermally insulating barrier 15 of the tank 1 is illustrated schematically. It can be made up of a plurality of insulating panels. In one embodiment, the panels of the bottom wall comprise rectangular panels and connecting panels arranged similarly to the rectangular panels 8 and the connecting panels 9, respectively.

We have described connecting panels 9 in a quadrilateral shape, two panels 9 touching only at their respective peaks, as one can see in FIGS. 1 and 5. In another embodiment illustrated in FIG. 8, the connecting panels 9' have the shape of a quadrilateral with cut tops, thereby forming a hexagon, and two adjacent connecting panels 9' are in contact on two sides.

The present invention is not limited to tanks. On the contrary, it concerns any cylindrical structure comprising a polygonal bottom wall made up of rectangular elements distributed in sectors and connecting elements between sectors.

Although the invention was described in connection with several particular embodiments, it is clear that it is in no way limited to them and that it includes all technical equivalents of the means described as well as their combinations, if these are within the scope of the invention.

The invention claimed is:

1. A tight and thermally insulated tank, the tank comprising a sealing barrier and a thermally insulating barrier, said sealing barrier having a regular polygonal cylindrical shape and comprising a vertical wall and a bottom wall, said vertical wall being made up of a plurality of vertical faces, said bottom wall comprising a plurality of sectors which are rotated images of each other in accordance with a predefined rotational angle, each sector consisting of a plurality of adjacent metallic rectangular pieces having an equal width and a plurality of identical metallic polygonal connecting pieces, wherein said bottom wall has the shape of a regular polygon, wherein said vertical wall forms a regular polygonal cylindrical surface having said regular polygon as a directrix, wherein each rectilinear side of the regular polygon corresponds to one of said sectors of the bottom wall and one of said faces of the vertical wall, the edges of the metallic rectangular pieces of one sector being respectively perpendicular and parallel to the rectilinear side of the polygon corresponding to said sector, wherein each polygonal connecting piece has a symmetrical quadrilateral shape, comprising two longer sides forming an angle equal to the predefined rotational angle and two shorter sides arranged at right angles to the longer sides, each shorter side having a length equal to one of the width and the half-width of the rectangular pieces, wherein the identical polygonal connecting pieces of a sector are arranged along an edge of the sector for connecting to the rectangular pieces of an adjacent sector, wherein a first one of the shorter sides of each polygonal connecting piece is parallel to the rectilinear side of the regular polygon corresponding to the sector and the second one of the shorter sides of each polygonal connecting piece is parallel to the rectilinear side of the regular polygon corresponding to the adjacent sector.

2. The tank according to claim 1, wherein said vertical wall comprises a plurality of adjacent metallic rectangular pieces, said metallic rectangular pieces of the vertical wall being identical to the metallic rectangular pieces of the bottom wall.

3. The tank according to claim 1, wherein said metallic rectangular pieces comprise rippled panels forming the sealing barrier.

4. The tank according to claim 1, wherein said rectangular pieces comprise metallic strakes with raised edges forming the sealing barrier.

5. The tank according to claim 1, further comprising panels in a thermally insulating material forming the thermally insulating barrier, which are arranged similarly to the metallic rectangular pieces.

6. The tank according to claim 1, wherein said bottom wall comprises a central piece to which rectangular pieces of each sector proximate to the central piece are connected.

7. The tank according to claim 1, wherein said vertical wall of the sealing barrier comprises a plurality of adjacent rectangular pieces, the sealing barrier further comprising a rectilinear corner bead arranged along one side of the regular polygon of said bottom wall, said corner bead comprising a horizontal board to which off center rectangular pieces of the corresponding sector are connected and a vertical board to which the rectangular pieces of the corresponding face of the vertical wall are connected.

8. The tank according to claim 1, wherein the rectangular pieces of one sector of the sealing barrier are identical rectangular pieces which are arranged in a plurality of adjacent rows, the rows being disposed at an increasing distance from a center of the bottom wall, each row comprising an integer number of the identical rectangular pieces, the integer number being an increasing function of the distance from the center of the bottom wall.

9. The tank according to claim 8, wherein the integer number of the identical rectangular pieces grows by one unit from one of the rows to the next.

10. The tank according to claim 8, wherein the respective identical polygonal connecting piece of the sector of the sealing barrier are arranged at an end of each row for connecting to the rectangular pieces of an adjacent sector.

11. The tank according to claim 8, wherein the longer side of each polygonal connecting piece has a length equal to a length of the identical rectangular pieces.

12. The tank according to claim 8, wherein said vertical wall comprises a plurality of adjacent rectangular pieces, said rectangular pieces of the vertical wall being identical to the rectangular pieces of the bottom wall.

13. The tank according to claim 8, wherein said rectangular pieces comprise rippled panels forming the sealing barrier.

14. The tank according to claim 8, wherein said rectangular pieces comprise metallic strakes with raised edges forming the sealing barrier.

15. The tank according to claim 8, further comprising panels in a thermally insulating material forming the thermally insulating barrier, which are arranged similarly to the metallic rectangular pieces.

16. The tank according to claim 8, wherein said bottom wall of the sealing barrier comprises a central piece to which rectangular pieces of each sector proximate to the central piece are connected.

17. The tank according to claim 8, wherein said vertical wall of the sealing barrier comprises a plurality of adjacent rectangular pieces, the sealing barrier further comprising a rectilinear corner bead arranged along one side of the regular polygon of said bottom wall, said corner bead comprising a horizontal board to which off center rectangular pieces of the corresponding sector are connected and a vertical board to which the rectangular pieces of the corresponding face of the vertical wall are connected.

18. The tank according to claim 1, wherein the thermally insulating barrier has a regular polygonal cylindrical shape and comprises a vertical wall and a bottom wall, the thermally insulating barrier being made up of a plurality of insulating panels in a thermally insulating material.

19. The tank according to claim 18, wherein the insulating panels of the bottom wall of the thermally insulating barrier comprise rectangular panels and connecting panels arranged similarly to the rectangular pieces and the connecting pieces of the sealing barrier.

* * * * *

UNITED STATES PATENT AND TRADEMARK OFFICE

CERTIFICATE OF CORRECTION

PATENT NO. : 8,550,276 B2
APPLICATION NO. : 12/447534
DATED : October 8, 2013
INVENTOR(S) : Richard et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 644 days.

Signed and Sealed this
Fifteenth Day of September, 2015

Michelle K. Lee

Michelle K. Lee
*Director of the United States Patent and Trademark Office*